United States Patent [19]

Bogorad

[11] 4,072,255

[45] Feb. 7, 1978

[54] DEVICE FOR APPLYING OR REMOVING SUPPORT STOCKINGS

[76] Inventor: Alissa Pam Bogorad, 120 E. 34th St., New York, N.Y. 10016

[21] Appl. No.: 795,959

[22] Filed: May 11, 1977

[51] Int. Cl.[2] ..... A47J 51/06

[52] U.S. Cl. ..... 223/111

[58] Field of Search ..... 223/111, 112, 113, 114

[56] References Cited

U.S. PATENT DOCUMENTS

| | | | |
|---|---|---|---|
| 2,443,115 | 6/1948 | Park | 223/111 |
| 2,796,207 | 6/1957 | Young | 223/111 |
| 3,310,209 | 3/1967 | Clauss | 223/111 |
| 3,401,856 | 9/1968 | Berlin | 223/111 |
| 3,883,052 | 5/1975 | Wilson | 223/111 |

*Primary Examiner*—George H. Krizmanich
*Attorney, Agent, or Firm*—Bernard Stickney

[57] ABSTRACT

A device for debilitated or geriatric patients to apply or remove anti-embolism support stockings comprising an overlapping circular band of a polymer impregnated fabric having its upper edge covered with moleskin to protect the patients' skin and stockings from injury and assist in the retention of the latter on the band and two bands of the polymer impregnated fabric connected to the band to serve as handles.

2 Claims, 9 Drawing Figures

FIG. 1.
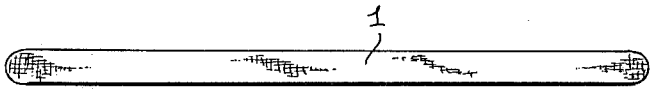
FIG. 2.
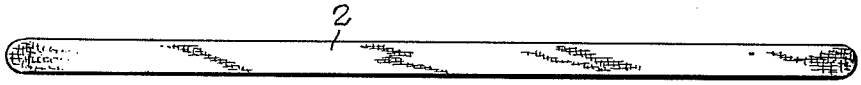
FIG. 3.
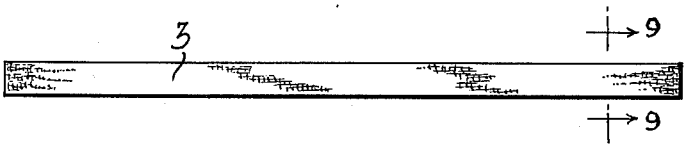
FIG. 4.
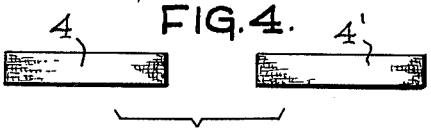
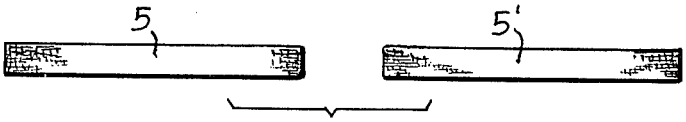
FIG. 5.
FIG. 6.
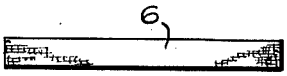
FIG. 8.
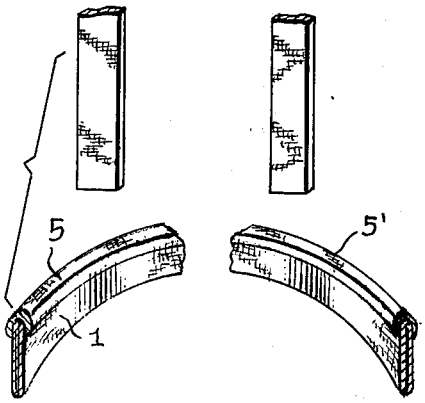
FIG. 9.
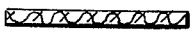
FIG. 7.
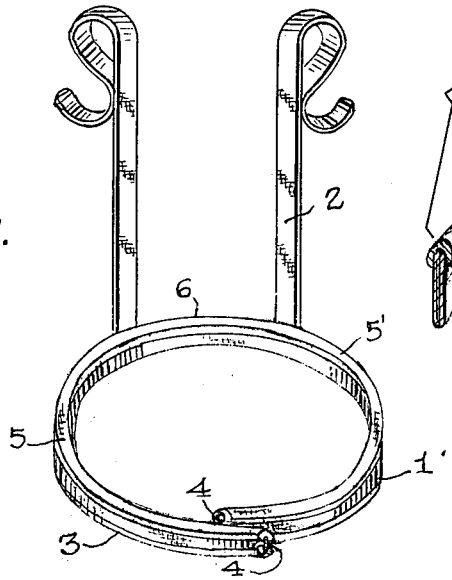

DEVICE FOR APPLYING OR REMOVING SUPPORT STOCKINGS

BACKGROUND OF THE INVENTION

It has been a long standing problem for debilitated or geriatric patients in hospitals or at home to put on or take off anti-embolism support stockings. The average healthy person would find it difficult to manipulate these strongly elastic stockings but it is more so for those with hip or knee joint ailments to bend over and apply them without assistance.

There have been numerous attempts to provide mechanical stocking pullers such as U.S. Pat. No. 2,903,170 with reciprocatable clamp members and U.S. Pat. No. 3,727,812 with pivotable arm members. These devices are generally bulky, require much manipulation and are relatively expensive to manufacture.

Accordingly, it is the primary object of this invention to provide a stocking applying or removing device of a simplified, relatively light weight construction yet sufficiently sturdy for the requisite pulling or pushing actions.

Another object of this invention is to provide a stocking applying or removing device which is adjustable for different circumferences in the top of the stocking.

A further object of this invention is to provide a stocking applying or removing device which is durable and yet relatively economical to manufacture.

BRIEF DESCRIPTION OF THE DRAWINGS

FIG. 1 is a plan view of the polymer impregnated strip used as the stocking holder.

FIG. 2 is a plan view of the polymer impregnated strip used for the handles.

FIG. 3 is a plan view of a moleskin strip used to cover the bottom edge of the holder.

FIG. 4 is a plan view of the moleskin strips to cover the ends of the stocking holder.

FIG. 5 is a plan view of the moleskin strips used to cover upper portions of the stocking holder.

FIG. 6 is a plan view of the moleskin used to cover an upper edge of the stocking holder between the handles.

FIG. 7 is a perspective view of the device of the invention.

FIG. 8 is a partial view of moleskin strips as applied to an edge of the stocking holder.

FIG. 9 is a cross section view of the material of the stocking holder and handles.

DESCRIPTION OF THE INVENTION

The device illustrated in FIG. 7 comprises a band 1 of a polymer impregnated fabric shown in cross section in FIG. 9. The material may be "Orthoplast," manufactured by Johnson and Johnson. It is normally used as a splint for bone fractures since it is sturdy, may be flexed and is relatively light. The following dimensions to be given are merely a preferred form of the invention. Thus, band 1 as shown in FIG. 1 may be 21 inches long and 2 inches wide and is formed in an overlapping circular-like band as shown in FIG. 7. Handle strips 2 made of the same material as the band, shown in FIG. 2 are 27 inches long and 2 inches wide. They are cemented to the band as shown in FIG. 7. To prevent the edges of the band from chafing the skin or damaging the stockings during use, 1 inch strips of adhesive moleskin are folded over the edges of the band. A moleskin strip 3 shown in FIG. 3 is 22 inches long and is folded and secured over the lower edge of band 1. Two strips 4, 2 inches long as shown in FIG. 4 are folded over the ends of the band. Along the upper edge of the band, two strips of moleskin 5, 6 inches long, shown in FIG. 5 are attached as shown in FIG. 7. Between the handles, a 7-inch strip of moleskin 6 shown in FIG. 6 is attached to the upper edge of the band. The flannel material of the moleskin serves the additional function of frictionally retaining the stocking on the band during operation of the device.

The use of the device is self-evident. Depending on the size of the wearer's foot and leg, the circular-like band's opening may be adjusted by moving the free ends of the band relative to each other. The open end of a stocking is introduced through the band's opening, expanded and draped over the protected upper edges of the band. The stiffness of the material maintains the band's circular-like shape against the tension of the expanded stocking. A foot on an extended leg is then introduced in the open stocking and by grasping the handles with both hands the stocking is pulled up along the leg. Where a patient may have only the effective use of one arm, both handles may be gathered in one hand since the material is flexible. The material is also sufficiently firm so that the reverse operation of removing the stocking may be accomplished. While the device was primarily intended for anti-embolism support stockings, it may obviously be used for all other types of stockings.

The advantages of the invention over the prior art are apparent from the foregoing description of its simplified construction and operation. There are no costly metal or plastic mechanical parts requiring machining operations. While various changes may be made in the details of construction, it is understood that such changes will be within the spirit and scope of the present invention.

I claim:

1. A device for applying or removing anti-embolism support stockings comprising a circular-like band of flexible, polymer impregnated fabric having free ends in close, overlapping relationship whereby the dimensions of the band may be adjusted as desired, a pair of handles made of said fabric and secured to said band on the side opposite to said overlapping ends, and separate protective means secured to all fully exposed edges of said band.

2. A device as defined in claim 1, wherein the protective means are strips of moleskin.

* * * * *